United States Patent [19]

Basche, deceased

[11] 4,135,030

[45] Jan. 16, 1979

[54] TUNGSTEN IMPREGNATED CASTING MOLD

[75] Inventor: Malcolm Basche, deceased, late of West Hartford, Conn., by Joyce O. Basche, heir

[73] Assignee: United Technologies Corporation, Hartford, Conn.

[21] Appl. No.: 863,838

[22] Filed: Dec. 23, 1977

[51] Int. Cl.[2] ..... B32B 1/06; B32B 3/26

[52] U.S. Cl. ..... 428/304; 106/38.2; 106/38.22; 164/24; 427/133; 428/450

[58] Field of Search ..... 427/133; 106/38.2, 38.22; 164/24, 26; 428/304, 312, 411, 450

[56] References Cited

U.S. PATENT DOCUMENTS

| | | | |
|---|---|---|---|
| 2,144,532 | 1/1939 | Hall | 428/304 |
| 2,806,271 | 9/1957 | Operhall | 164/24 |
| 3,177,084 | 4/1965 | Amstein | 428/408 |
| 3,180,632 | 4/1965 | Katz et al. | 428/408 |
| 3,494,997 | 2/1970 | Dittrich et al. | 264/221 |
| 3,537,949 | 11/1970 | Brown et al. | 428/472 |
| 3,556,843 | 1/1971 | Buck | 428/304 |
| 3,669,724 | 6/1972 | Brand | 428/450 |

*Primary Examiner*—William J. Van Balen
*Attorney, Agent, or Firm*—Charles E. Sohl

[57] ABSTRACT

A method for producing a low reactivity tungsten impregnated ceramic mold for casting refractory metals such as titanium is described. The method involves impregnation of a standard ceramic shell mold with an aqueous solution of tungstic acid and ammonium hydroxide. The saturated mold is then dried and fired to convert the tungsten compound to metallic tungsten or tungsten oxides. The process may be repeated several times to achieve the desired tungsten concentration.

5 Claims, No Drawings

TUNGSTEN IMPREGNATED CASTING MOLD

BACKGROUND OF THE INVENTION

1. Field of the Invention

This invention relates to the production of molds for producing investment castings of titanium and similar metals and alloys.

2. Description of the Prior Art

It is known in the metal working art to employ coatings on molds and dies to reduce reactivity between the metal being treated and the mold or die material. This is shown for example in U.S. Pat. Nos. 2,806,271 which shows deposition on the mold surface of a metal film of the metal to be cast; 3,177,084 which shows the application of a carbide layer to graphite forging dies; 3,537,949 which describes layered shell mold in which the first layer comprises a powdered nonreactive metal and subsequent layers of ceramic and 3,680,626 which describes the use of a surface layer of a boron containing ferrous material in the casting of aluminum articles. U.S. Pat. No. 3,180,632 describes a graphite mold for casting titanium and the provision of a rare earth oxide layer on the mold surface.

U.S. Pat. No. 3,494,997 describes a ceramic mold which is produced with a binder composed of heterogeneous metal alcoholates. These alcoholates presumably decompose upon firing. The prior art relating to the investment casting of titanium is described in the booklet "Investment Casting of Refractory Metals" by Mueller and Koon, published in 1972 by Rem Metals Corporation, Albany, Oregon. This booklet discloses that it is known in the prior art to use tungsten molds in the casting of titanium and that such molds produce superior castings. The mold production method described involves a first layer of tungsten powder and binder with subsequent layers of ceramic material and binder.

SUMMARY OF THE INVENTION

Low reactivity molds for casting titanium and similar reactive metals are produced by impregnating conventional ceramic shell molds with a solution containing a tungsten compound which decomposes upon heating to form metallic tungsten and possibly tungsten suboxides. As used herein, the term tungsten includes the suboxides of tungsten and mixtures of metallic tungsten and suboxides of tungsten. The preferred tungsten compound for inclusion in the solution, is tungstic oxide which can be dissolved in an aqueous solution of ammonium hydroxide. The impregnation step is repeated with intermediate dryings and firings at elevated temperatures to remove the volatile components and convert the tungstic oxide to tungsten. The finished molds are nonreactive to titanium, are considerably less prone to catastrophic failure than are ceramic molds and are sufficiently electrically conductive to permit heating of the mold in an RF field.

DESCRIPTION OF PREFERRED EMBODIMENTS

The present invention involves a method of impregnating porous ceramics with a material which can be decomposed to produce tungsten. The molds so produced may be used in the casting of titanium and titanium alloys. It is also anticipated that the mold will have utility in the casting of similar metals such as columbium and molybdenum and alloys based on these metals. The method is broadly applicable to a wide variety of ceramics, including ceramics based on alumina, zirconia and magnesia. Although any such porous ceramic may be treated by the process of the invention so as to be made essentially nonreactive with molten titanium, the process of the invention has particular utility with respect to investment shell molds made with disposable patterns. Such molds are well known in the prior art and are described in U.S. Pat. Nos. 2,912,729, 2,945,273 and 3,754,945 which are incorporated herein by reference. The particular mold fabrication process employed does not form a part of the present invention.

The present invention involves impregnation of the ceramic mold with a tungsten containing solution which will decompose at elevated temperatures to form tungsten compound on the surface and internal pores and passages of the ceramic. One such compound is tungstic oxide which may be dissolved in an aqueous solution of ammonium hydroxide and used to impregnate ceramic articles. Upon heating at elevated temperatures, the tungsten compound in the ceramic pores will decompose. In this particular case, the tungsten compound is believed to be ammonium tungstate so that upon firing the decomposition product will be gaseous ammonia and water vapor which will dissipate from the mold leaving no residue except the desired tungsten. This lack of residue is important in view of the well known reactivity of titanium. As an alternative, ammonium tungstenate could be dissolved in water and used as an impregnating bath to produce the same result.

The object of the process is to deposit metallic tungsten in the pores of the ceramic as rapidly as possible. Thus, while repeated applications of dilute solutions may be employed with intermediate firings, it is preferred to use a saturated solution of tungstic oxide in a strong aqueous solution of ammonium hydroxide. It has been experimentally determined that by using a 50% ammonium hydroxide solution and dissolving a saturation amount of tungstic oxide in the solution, a mold of greatly reduced reactivity may be obtained with only two impregnation steps. Although not experimentally verified, it is anticipated that by using heated solution, even more of the tungsten compound could be dissolved leading to more complete impregnation for a particular number of impregnation steps. It is also suggested that the impregnation steps could be accelerated by the application of external pressure or vacuum to a chamber containing the impregnation solution so as to accelerate the infiltration of the solution into the porous ceramics. An autoclave might be employed to accelerate impregnation through the simultaneous action of heat and pressure.

After impregnation, the mold will be found to be electrically conductive as a consequence of the formation of the thin continuous tungsten film throughout the porous ceramic mold. This conductivity is believed to be potentially beneficial in that it might permit preheating of the mold by RF induction heating. The continuous tungsten film also serves to strengthen the mold and increase its ductility, especially at low and intermediate temperatures. This increase in ductility is beneficial in that it reduces the possibility of catastrophic failure during the casting operation. It is postulated that the presence of a significant amount of tungsten in the mold material will increase the thermal conductivity of the mold, thus decreasing the thermal gradients and thermal stress in the mold during the metal casting operation.

This invention may be better understood by reference to the following illustrative example:

EXAMPLE

An investment shell mold made of zircon refractory aggregate particles bonded together with an inorganic colloidal silica binder was provided. The mold was porous and had a wall thickness of about 0.04 inch.

A 50% aqueous solution of NH4OH was prepared and saturated with tungstic acid powder at room temperature. The mixture was thoroughly stirred and then allowed to stand so that excess tungstic acid settled to the bottom. The clear saturated solution was decanted off and used to treat the ceramic mold. The mold was immersed in the solution for ½ hour to insure full penetration of the solution (in less than 10 minutes, solution poured into the mold cavity appeared on the outside of the mold). The mold was then removed from the solution, dried in air (in a small drying oven) and then fired in hydrogen at 950° C for 1 hour. After this cycle, the mold had turned a metallic black color. Two such treatments were sufficient to lower the electrical resistivity of the outside of the mold to approximately 50–60 ohms. After three such treatments, the mold was somewhat conductive (300 ohms) through its wall thickness. Under these conditions, the mold will suscept when placed in a proper induction coil.

A mold was prepared as described above using only two impregnations and a casting was made by drip melting arc-melted titanium into the mold under vacuum. A control casting in an untreated zircon mold was made at the same time. The untreated mold casting was removable but a clearly discernible "tarnish" was visible on the surface of the casting whereas the casting from the treated mold was clean and bright. The inner surfaces of the untreated mold also showed extensive signs of reaction with the cast metal whereas the treated mold showed few signs of reaction.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of my invention, that which I claim as new and desire to secure by Letters Patent of the United States is:

1. Method for producing a low reactivity tungsten impregnated ceramic mold including the steps of:
   a. providing a porous ceramic mold;
   b. providing an aqueous solution containing tungstic acid;
   c. saturating the mold in the tungstic acid solution;
   d. drying the mold;
   e. firing the mold to convert the tungsten acid to tungsten or tungsten oxide.

2. A method as in claim 1 wherein steps c, d, and e are repeated.

3. A method as in claim 1 wherein the aqueous solution contains ammonium hydroxide and tungstic acid.

4. A method as in claim 1 wherein the aqueous solution is prepared by dissolving ammonium tungstate in water.

5. A tungsten impregnated ceramic mold useful for casting reactive metals consisting of:
   a porous ceramic mold whose internal pores and passages are coated with a thin layer of a material selected from the group consisting of metallic tungsten, tungsten oxide, tungsten suboxides, and mixtures thereof, said mold being electrically conductive.

* * * * *